United States Patent [19]

Baer

[11] Patent Number: 4,999,879

[45] Date of Patent: Mar. 19, 1991

[54] PINLESS HINGE STRUCTURE WITH GEAR PORTIONS

[76] Inventor: Austin R. Baer, 1115 N. Ellsworth, Villa Park, Ill. 60181

[21] Appl. No.: 434,312

[22] Filed: Nov. 13, 1989

[51] Int. Cl.[5] ..... E05D 7/00

[52] U.S. Cl. ..... 16/354; 16/273

[58] Field of Search ..... 16/354, 273

[56] References Cited

U.S. PATENT DOCUMENTS 3,422,487 1/1969 Dickinson et al. ..... 16/354

FOREIGN PATENT DOCUMENTS 2457413 6/1975 Fed. Rep. of Germany ..... 16/354

*Primary Examiner*—Richard K. Seidel
*Assistant Examiner*—Carmine Cuda
*Attorney, Agent, or Firm*—Gravely, Lieder & Woodruff

[57] ABSTRACT

A pinless hinge structure having two hinge members which are rotatably joined for movement between open and closed positions. The hinge members have longitudinally extending gear segments which intermesh with an interior surface on a clamp member such that each hinge member moves about an axis of rotation which shifts as a function of the position of the hinge members. A thrust bearing assembly inhibits relative longitudinal movement between the hinge members and the clamp member.

31 Claims, 6 Drawing Sheets

10
12
14
16
18
20
22
24
28
30
32
34
36
38
40
42
112
114
116
118
120
122
124
128
130
132
134
136
137
138
140
142

216
228
242
214
232
234
230
220
222
224
212
218
240
244
252
248
254
250
246
210
9

PINLESS HINGE STRUCTURE WITH GEAR PORTIONS

FIELD OF THE INVENTION

The present invention relates to hinge structures and, more particularly, to a pinless hinge structure operable between open and closed positions and including two hinge members whose axes of rotation shift as a function of the position of the hinge members.

BACKGROUND OF THE INVENTION

A hinge structure normally includes two hinge members which are rotatably secured together by a pin or the like. Automatically operated doors, such as those commonly used in shopping centers, schools or the like are continually operated and are substantially heavier and larger than those used in most homes. As will be understood, continual use of the door submits the hinge structure to extensive wear. Notwithstanding their continual use and the substantial load placed thereon, a hinge structure is expected to perform error-free and with minimum maintenance.

Increases in height and/or weight of the door or the like carried by the hinge member, adds to the frictional sliding contact between the hinge members and thereby increases the wear on the hinge structure. As may be appreciated, and despite the wear on such hinge structures, the hinge members are not normally permitted to longitudinally move relative to each other during their operation.

My U.S. Pat. No. 3,092,870, dated June 11, 1963, discloses a pinless hinge structure offering increased performance and durability. Such a hinge structure includes two longitudinally extending hinge members which are rotatably joined along adjacent longitudinal edges by intermeshing gear segments forming part of the hinge members. A clamp member maintains the gear segments in mesh relative to each other while permitting smooth and uniform movement of the hinge members through a full arc of travel of the hinge. The clamp member has a generally C-shaped cross section whose inwardly turned ends are formed with longitudinally extending rod-like portions. Each rod-like portion on the clamp member fits within a longitudinal channel formed in the gear segment and defines a fixed axis of rotation for each hinge member.

When the hinge structure is closed, it is desirable for the clamp member to be brought close to the hinge members to enhance security The hinge members of my patented design, however, rotate about fixed axes. Therefore, the clamp member is normally arranged at a fixed distance from the hinge members when the hinge structure is closed. The ability to arrange the clamp member proximate to the hinge members further enhances aesthetic features of the hinge structure.

The design and performance of the hinge structure disclosed in the above-identified patent was further enhanced through the provision of a longitudinal thrust bearing assembly which was the subject of my U.S. Pat. No. 3,402,422, dated Sep. 24, 1968. My patented longitudinal thrust bearing assembly inhibits longitudinal movement of one hinge member with respect to the other hinge member.

Preferably, several thrust bearing assemblies are longitudinally spaced along the length of the door to distribute their load-bearing capability. Because the hinge members rotate about fixed axes, the gear segments have limited or local contact with the bearing assembly. Despite their improved performance, and because of their localized contact about fixed axes of rotation which is limited to the cross-sectional area of the gear segment (which is reduced by the longitudinal channel formed therein to accommodate the rod-like portion of the clamp member), relative sliding engagement between the hinge members and the thrust bearing do, on occasion, result in wear thus requiring replacement of the thrust bearing assembly.

Replacement of any or all of the thrust bearing assemblies normally requires complete disassembly of the hinge structure from the associated door. As will be appreciated, repairs on a door leading to a commonly frequented building such as a school, hospital, or the like, interrupts or limits accessibility to such a building. Even if only for a short time period, such interruptions to building access are undesirable and, therefore, should be maintained to a minimum if not eliminated. As will be appreciated, any change in the hinge structure design which will facilitate an increase in performance of either the hinge structure or the bearing assembly would be beneficial.

SUMMARY OF THE INVENTION

In view of the above, and in accordance with the present invention, there is provided a hinge structure having two hinge members which are movable between open and closed positions. Each hinge member moves about an axis of rotation which shifts as a function of the position of the hinge member. The hinge members are maintained in rotatable association with each other by a clamp member.

The hinge members are rotatably joined to each other throughout their range of movement between open and closed positions. Each hinge member has a gear segment with a leg segment extending outwardly from the gear segment. Each leg segment has inner and outer surfaces defined thereby. In one form of the invention, a longitudinally extending rod-like projection is provided between the hinge members to define a common pivotal axis for the hinge members. The common pivotal axis shifts as a function of the position of the hinge members.

The clamp member is configured to intermesh with each of the gear segments formed on the hinge members. In a preferred form, the clamp member has two spaced-apart and joined leg sections with the gear segments of the hinge members captively received therebetween. Each leg section of the clamp member has a gear tooth profile on its interior surface which complements that of the gear segment. At least the leg sections of the clamp member may be formed from a resilient material and define camming surfaces at their free ends for facilitating assemblage of the hinge structure.

In another form of the invention, the gear segments are formed along adjacent longitudinal edges of the hinge members and are mutually intermeshing throughout the arc of travel of the hinge members. Rather than pivoting about a fixed axis, each gear segment includes a series of gear teeth which roll along the interior surface of the clamp member as the hinge members move between positions. Moreover, and because the gear segments of the hinge members do not pivot about fixed axes which require a reduction of cross-sectional area to receive means for pivoting, they are designed with an increased surface area as compared to the gear segments of my previous patented design.

The gear teeth on the gear segments can be formed on surfaces of irregular radius. In one form, each gear segment has a cross section having an epicyclic profile. In another form, adjacent gear teeth on a first portion of the gear segment are formed on the surface of a segment of a predetermined radius and with adjacent gear teeth on a second portion of the gear segment being formed on the surface of a segment of a radius which is different from the predetermined radius.

The gear tooth profile on the leg sections of the clamp member complements the gear segments formed on the hinge members. The leg sections of the clamp member may extend generally parallel to each other or, in an alternative embodiment, converge toward each other and permit the hinge members to define an included angle of about 270° therebetween when the hinge members are arranged in a closed position.

In yet another form of the invention, the clamp member is a two-piece structure comprised of a rigid outer member and an essentially flexible inner member having a geared tooth profile on its interior surface. A two-piece clamp member has the principal advantage of producing hinges which can be assembled entirely by lateral abutment or juxtapositioning of the parts (as opposed to sliding or endwise assembly) without compromising the lateral strength of the hinge structure for ease of assembly.

A two-piece clamp member also affords the following advantages. Lower flexural stress on the on flexible inner member as it is pressed over the rotatably joined gear segments on the hinge members during assembly. Consequently, there are lowered assembly forces with less deformation damage to the interior profiled surface of the flexible inner member during assembly. The inner member can be uniformly finished and lubricated and, thereby, is less subject to dimensional variations caused by a variety of anodizing densities and thicknesses which can vary with color and other specifications, or because of various painted coating or plating thicknesses and the like. The use of a two-piece clamp member allows fabrication of a hinge subassembly comprising the flexible inner member with the gear segments of the hinge members in rotatable association therewith. Moreover, the ability to partially preassemble the hinges prior to the application of color finishes, and the like, facilitates the development of a hinge structure inventory in advance of the receipt of orders for such hinge structures. The provision of a rigid outer member affords extremely high lateral stress resistance to the completed hinge structure by using an outer member of virtually unlimited rigidity or thickness. Furthermore, a two-piece clamp member allows interchangeability between parts which may be made of different materials or have finishes of different characteristics and irrespective of the finished coating thickness, lubricant retentive characteristics, or mechanical performance as a geared surface and furthermore lessens the precision required on the internal contours of the outer member. As will be appreciated, the ability to assemble the hinge structure as through lateral abutment of the clamp member relative to the hinge members also conserves on manufacturing space by eliminating the need for an assembly area at least the twice the length of a given hinge structure where the clamp member is to be endwise assembled relative to the hinge members.

A series of thrust bearing assemblies are disposed along the length of the hinge members. Each thrust bearing assembly includes a thrust bearing member which is accommodated within coextensive lateral recesses defined along adjacent longitudinal edges of the hinge members. The thrust bearing member extends across adjacent longitudinal edges of the hinged members and defines upper and lower bearing surfaces which slidably engage upper and lower surfaces of the recesses defined by the hinge members in a manner inhibiting relative longitudinal movement of the hinged members. Preferably, the thrust bearing member is formed from a non-metallic material for reducing frictional contact between it and the hinge members and thereby advantageously increasing the durability of the bearing assembly.

In one form, the thrust bearing member includes longitudinal projections laterally extending from opposite sides of the bearing member. The lateral projections are configured to engage with the gear tooth profile on the leg sections of the clamp member. In another form, the projections are adapted to resiliently flex inwardly toward the bearing member attendant to insertion of the thrust bearing member within the lateral recesses defined on the hinge members.

To promote insertion and removal of a thrust bearing assembly having such lateral projections provided thereon relative to the hinge members, the thrust bearing member is defined with a longitudinal slot. The longitudinal slot permits lateral compression of the thrust bearing member which facilitates its insertion and removal from the lateral recesses in the hinge members. The thrust bearing member may be further configured with tool accommodating recesses or flanges for facilitating lateral compression of the hearing member.

To enhance the aesthetic features of the hinge structure, a decorative treatment can be provided along an exterior surface of the clamp member. The decorative treatment may take the form of a foil, sheet material, wood veneer, or the like which may offer a contrasting color or surface treatment to the area wherein the hinge structure is used. The ability to add a decorative treatment to the clamp member is important to the extent that it cannot be done with conventional hinge structures that have interlocking knuckles.

A salient feature of the present invention is the ability to move the hinge members between open and closed positions about an axis of rotation which shifts as a function of the position of the hinge members. In the closed position, the gear segments of each hinge member are positioned further within the interior profiled surface of the clamp member to allow the clamp member to be arranged closer to the frame offering tighter security, a cleaner appearance and more effective sealing against dust, light, sound and heat energy. As the hinge members are moved to the open position, each gear segment rolls along the interior profiled surface of the clamp member.

The design of a hinge structure wherein gear segments roll along the interior surface of the clamp member rather than pivot, advantageously promotes an increase in the surface area of the gear segments as compared to my previous design. An increase in the surface area of the gear segments facilitates broader surface area contact between the gear segments and the upper and lower surfaces of the thrust bearing assembly Moreover, during movement of the hinge members, the gear segments shift across the bearing surfaces of the thrust bearing assembly rather than pivot thereon to establish a shifting action which distributes wear characteristics of the thrust bearing assembly across a larger cross-sectional area.

Numerous other features and advantages of the present invention will become apparent from the following detailed description, the accompanying drawings, and the appended claims.

DETAILED DESCRIPTION OF THE PREFERRED EMBODIMENTS

Figures 1, 2, 3, 4, 5:
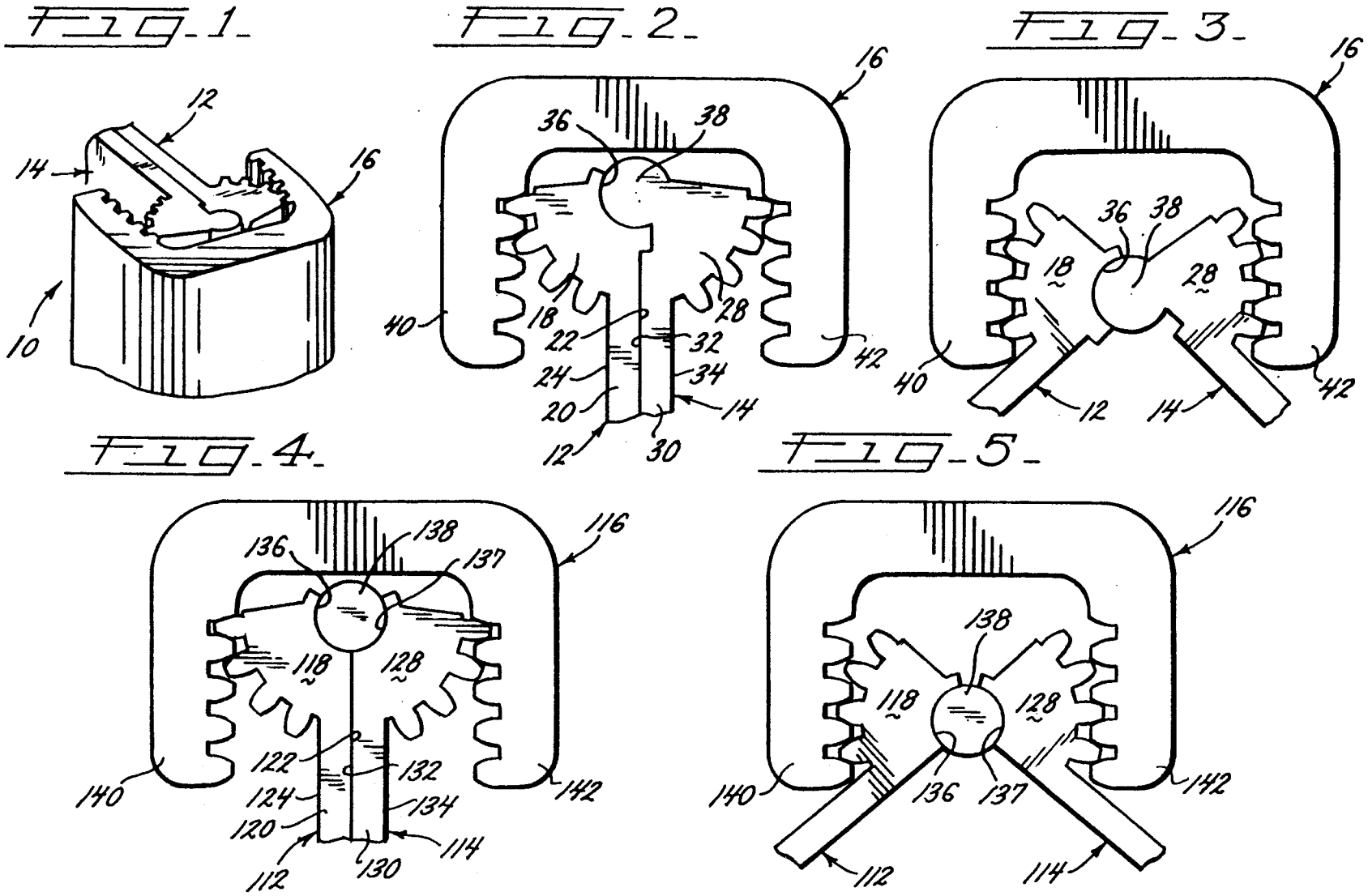
FIG. 1 is a perspective view of one embodiment of a hinge structure according to the present invention.
FIG. 2 is a partial top plan view of the hinge structure of FIG. 1 illustrated in a closed position.
FIG. 3 is a partial top plan view of the hinge structure of FIG. 1 illustrated in an open position.
FIG. 4 is a partial top plan view of a second embodiment of a hinge structure in a closed position.
FIG. 5 is a partial top plan view of the hinge structure of FIG. 4 illustrated in an open position.

While the present invention is susceptible of embodiment in various forms, there are shown in the drawings and will hereinafter be described, preferred embodiments of the present invention with the understanding that the present disclosure is to be considered as exemplifications of the invention which are not intended to limit the invention to the specific embodiments illustrated.

Referring now to the drawings, there is illustrated a pinless hinge structure 10. As illustrated in FIG. 1, the pinless hinge structure includes first and second longitudinally extending hinge members 12, 14, respectively. A longitudinally extending clamp member 16 maintains the hinge members 12, 14 in rotatable engagement relative to each other.

The hinge members illustrated and described hereinafter in each of the different embodiments can be formed from a wide variety of metals, plastics, and other materials, and can be fabricated by machining the elements from stock of appropriate cross section, or by rolling, drawing, die-casting, or preferably, by extruding these materials. In the later case, any extrudable material of the requisite strength may be employed such as a brass, aluminum, thermoplastic polymer and the like.

Turning now to FIG. 2, the first hinge member 12 is formed with a longitudinally extending gear segment 18 and has an outwardly extending leg segment 20 joined thereto. Leg segment 20 includes inner and outer surfaces 22 and 24, respectively. The second hinge member 14 includes a longitudinally extending gear segment 28 and has an outwardly extending leg segment 30 joined thereto. As illustrated, leg segment 30 includes inner and outer surfaces 32 and 34, respectively. The leg segments 20, 30 of the hinge members 12, 14, respectively, are secured to door panels or the like. As will be understood, the leg sections of the hinge members can be configured and/or extended to provide, for example, an intrinsically formed door jamb or channel for window or plate glass, and etc.

The hinge members 12 and 14 are rotatably joined to each other. To effect such ends, hinge member 12 is provided with a longitudinally extending channel 36 formed along a longitudinal edge thereof. Channel 36 defines a generally cylindrical surface having an apex which coincides with the axes of rotation of hinge members 12 and 14. Hinge member 14 is formed with a longitudinally extending rod-like projection 38 which is rotatably accommodated within channel 36 of hinge member 12. As illustrated in FIG. 2, the apex of rod-like projection 38 coincides with the axes of rotation of hinge members 12 and 14 such that the rod-like projection 38 is provided between and defines a common pivotal axis for the hinge members 12, 14. As seen in FIGS. 2 and 3, the common pivotal axis for hinge members 12, 14 shifts as a function of the position of the hinge members.

As illustrated in FIG. 2, the longitudinally extending clamp member 16 has a generally channel or C-shaped cross section including two spaced-apart and joined leg sections 40, 42 which captively maintain gear segments 18, 28 of hinge members 12, 14, respectively therebetween. An interior surface of each leg section 40, 42 has a gear tooth profile which intermeshes with and complements that of the gear segments 18, 28. The clamp member 16 can be formed from a relatively rigid material or advantageously from a resilient material that will tend to maintain spring pressure against the gear segments 18, 28 in a manner maintaining mutual intermeshing relation therebetween.

The gear segments 18, 28 illustrated in FIGS. 2 and 3 include a series of gear teeth which are arranged on a surface having a substantially circular cross section. The gear teeth on each gear segment are adapted to intermesh with the gear teeth on the adjacent leg section of the clamp member 16 as the hinge members pivot about projection 38 and roll along the interior profiled surface of clamp member 16.

An alternative form of a pinless hinge structure 110 is illustrated in FIGS. 4 and 5. The pinless hinge structure 110 is substantially similar to hinge structure 10 illustrated in FIGS. 1 through 3 and like parts will be referenced with like numerals in the one-hundred series.

Hinge structure 110 includes hinge members 112 and 114 which are rotatably joined together by a clamp member 116. Hinge member 112 includes a gear segment 118 which is provided with a longitudinally extending channel 136 formed along a longitudinal edge thereof. Hinge member 114 includes a gear segment 128 which is likewise provided with a longitudinally extending channel 137 formed along an adjacent longitudinal edge. Channels 136 and 137 combine to form a substantially contiguous cylindrical surface when the hinge members 112 and 114 are arranged in a closed position as illustrated in FIG. 4. The apex of the cylindrical surfaces defined by channels 136, 137 coincides with the axes of rotation of hinge member 112, 114.

A longitudinally extending pin or rod 138 is captively received and maintained between the channels 136, 137 to define a common pivotal axis for the hinge members 112, 114. As illustrated in FIGS. 4 and 5, the common pivotal axis for the hinge members 112, 114 shifts as a function of the position of the hinge members.

In the embodiments illustrated in FIGS. 2 through 5, there is illustrated one "tooth" meshing between the gear segments on the hinge members and leg sections on the clamp member. This is important because 90 percent of hinge applications require only 90 degree door rotation. It should be appreciated, however, that the arc of travel of the hinge members is expandable by extending the surface area on which the gear teeth are formed.

Figures 6, 7, 8, 9:
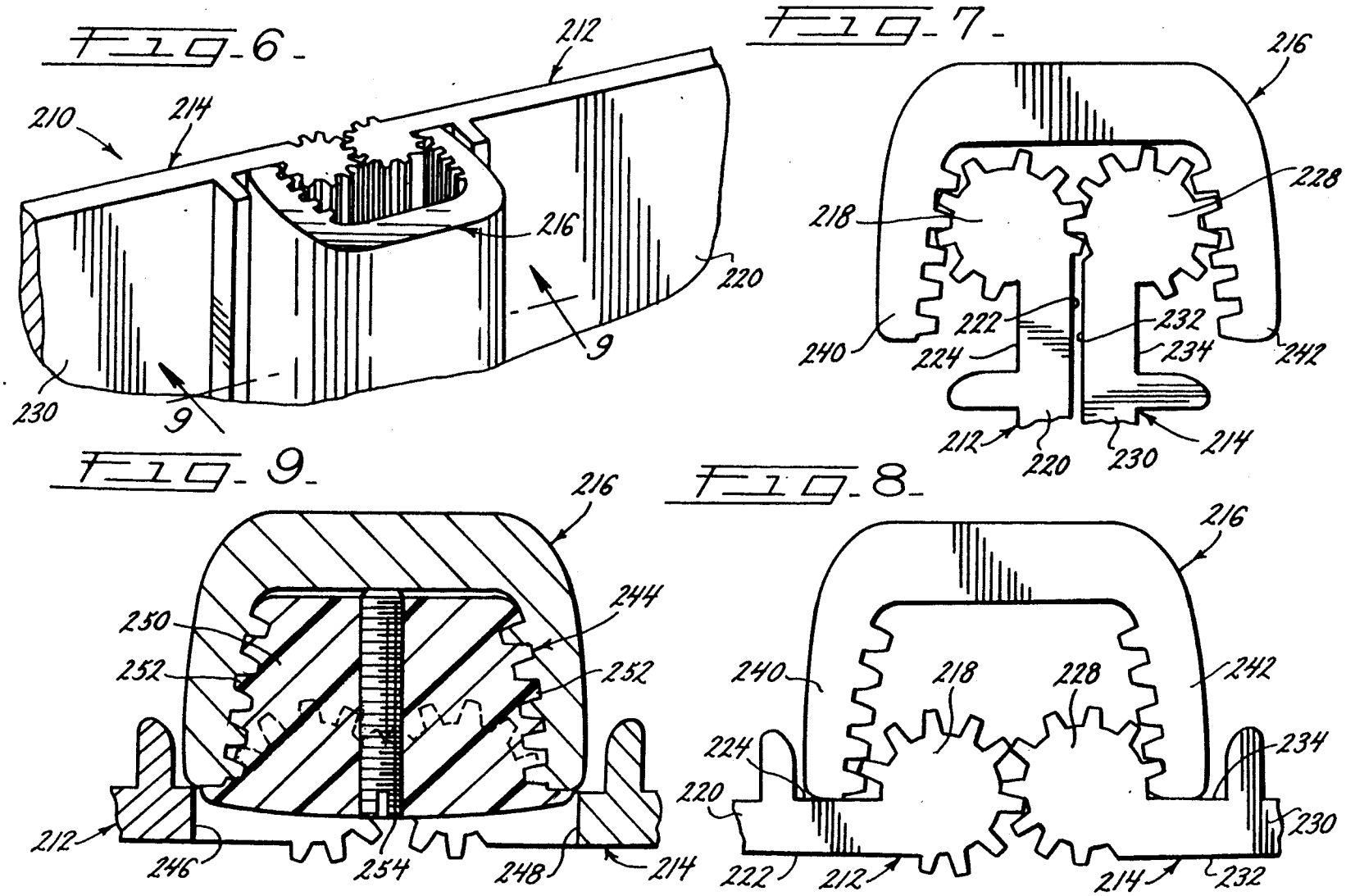
FIG. 6 is a perspective view of a third embodiment of a hinge structure according to the present invention.
FIG. 7 is a partial top plan view of the hinge structure of FIG. 6 illustrated in a closed position.
FIG. 8 is a partial top plan view of the hinge structure of FIG. 6 illustrated in an open position.
FIG. 9 is a partial cross-sectional view taken along line 9—9 of FIG. 6 and illustrating one form of thrust bearing assembly used in combination with the hinge structure.

Another alternative form of hinge structure 210 is illustrated in FIGS. 6 through 8. The pinless hinge structure 210 includes first and second longitudinally extending hinge members 212, 214, respectively, which are rotatably joined along their adjacent longitudinal edges. A longitudinally extending clamp member 216 maintains the hinge members 212, 214 in rotatable engagement relative to each other.

Turning now to FIG. 7, the first hinge member 212 is formed with a longitudinally extending gear segment 218 at one longitudinal edge and has an outwardly extending leg segment 220 joined thereto. Leg segment 220 includes inner and outer surfaces 222 and 224, respectively. The second hinge member 214 includes a longitudinally extending gear segment 228 at one longitudinal edge which is intermeshed with the gear segment 218 and has an outwardly extending leg segment 230 joined thereto. As illustrated, leg segment 230 includes inner and outer surfaces 232 and 234, respectively. The leg segments 220, 230 of the hinge members 212, 214, respectively, are secured to door panels or the like. As will be understood, the leg sections of the hinge members can be configured and/or extended to provide, for example, an intrinsically formed door jamb or channel for window or plate glass, and etc.

As illustrated in FIG. 7, the longitudinally extending clamp member 216 has a generally channel or C-shaped cross section including two spaced-apart and joined leg sections 240, 242 which captively maintain gear segments 218, 228 of hinge members 212, 214, respectively therebetween. An interior surface of each leg section 240, 242 has a gear tooth profile which intermeshes with and complements that of the gear segments 218, 228. The clamp member 216 can be formed from a relatively rigid material or advantageously from a resilient material that will tend to maintain spring pressure against the gear segments 218, 228 in a manner maintaining mutual intermeshing relation therebetween.

The gear segments 218, 228 illustrated in FIGS. 7 and 8 include a series of gear teeth which are arranged on a surface having a substantially circular cross section. Gear teeth on a first portion of each gear segment are adapted to intermesh with the gear teeth on the adjacent leg section of the clamp member 16. Gear teeth on a second portion of each gear segment are adapted to mutually intermesh with the gear teeth on the adjacent gear segment. As illustrated in FIG. 8, the gear teeth on the gear segments 218, 228 are configured to inhibit the hinge members 212, 214 from rotating out of association with the clamp member 216.

It should be appreciated that the gear segments 218, 228 could also include a series of gear teeth which are arranged on the surface of a spiral segment. With such an arrangement, one gear segment would have an increasing radius and the other gear segment would have a decreasing radius as long as the sum of the radii is substantially constant throughout the range of rotation of the hinge members.

When the hinge members 212, 214 are moved from their closed position, illustrated in FIG. 7, to an open position, illustrated in FIG. 8, the gear segments 218, 228 roll along the interior geared profile of leg sections 246, 242 of the clamp member 216. Thus, the axis of rotation about which each hinge member moves is shifted as a function of the position of the hinge members.

The hinge members 212, 214 comprising the hinge structure 210 are interconnected by the longitudinally extending, mutually intermeshed gear segments 218, 228 and by their longitudinal engagement with the interior surface on the clamp member 216. As illustrated in FIG. 9, a thrust bearing assembly 244 inhibits longitudinal movement of the hinge members 212, 214 relative to each other.

As may be appreciated, more than one thrust bearing assembly may be provided along the length of the hinge structure to distribute the load-bearing capability of the hinge structure over the length thereof. For purposes of discussion, however, only one thrust bearing assembly will be discussed in detail, with the understanding that the other thrust bearing assemblies disposed along the length of the hinge structure may be substantially similar in construction.

As illustrated in FIG. 9, the hinge members 212, 214 define longitudinally coextensive lateral recesses 246 and 248, respectively, along adjacent longitudinal edges thereof. The thrust bearing assembly 240 is disposed within the lateral recesses 246, 248 defined by the hinge members. The thrust bearing assembly 244 may be of the type disclosed in my U.S. Pat. No. 3,402,422, dated Sep. 24, 1968; the entirety of which is incorporated herein by reference.

As illustrated in FIG. 9, thrust bearing assembly 244 includes a thrust bearing member 250 which extends across adjacent longitudinal edges of the hinge members 212, 214 to inhibit relative movement therebetween. The longitudinal dimensions of the thrust bearing member 250 and the recesses 246, 248 are such that there is just sufficient clearance therebetween to permit the hinge members to move through their path of travel without binding on the thrust bearing assembly.

Figure 10:
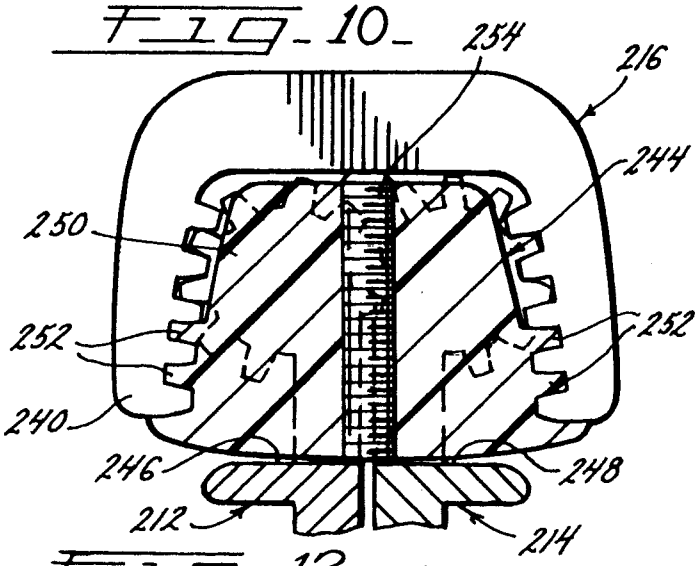
FIGS. 10 through 12 are partial cross-sectional views similar to FIG. 9 illustrating alternative forms of a thrust bearing assembly.

As illustrated in FIGS. 9 and 10, the thrust bearing member 250 advantageously has a cross section that conforms essentially to the cross-sectional configuration of the interior of clamp member 216 and extends outwardly from the open side thereof a relatively short distance to maximize the upper and lower bearing surfaces defined by the thrust bearing member 250 which support the hinge members 212, 214. The lateral recesses 246, 248 in the hinge members 212, 214, respectively, are laterally sized to not interfere or abut against the thrust bearing member 250 when the hinge structure is closed. Preferably, the thrust bearing member 248 is formed from a non-metallic material such as acetal resin-type plastic. Such materials are commonly sold under the trade name "DELRIN" by DuPont Corporation.

Relative longitudinal movement of the clamp member 216 with respect to the two hinge members 212, 214 can be prevented by securing or fastening the bearing member 250 to the clamp member 216. As illustrated in FIGS. 9 and 10, the thrust bearing member 250 can be formed with one or more longitudinally extending projections or teeth 252 an opposite lateral sides thereof. The projections 252 are adapted to slidably engage with the gear teeth provided along the interior surface of each leg section 240, 242 of clamp member 216 during endwise assembly of the hinge structure. A set screw 254 passes through and threadably engages the bearing member 250. As will be understood, the interengagement between the projections 252 on bearing member 250 and the gear tooth profile on the leg sections 240, 242 of the clamp member 216 allows the set screw 254 to press against a rear wall or surface on the clamp member 216 in a manner inhibiting longitudinal movement between the clamp member 216 and the hinge member 212, 214.

Other types of fasteners could be likewise used to effect the same ends. As an example, the bearing member 250 can be secured to the clamp member 216 by means of a set screw which threadably engages and passes through a rear wall of the clamp member. Other means for securing the bearing member 250 to the clamp member 216 may be used, such as, for example, by squeezing, pinching, or adhesively securing the parts to each other.

Figure 12:
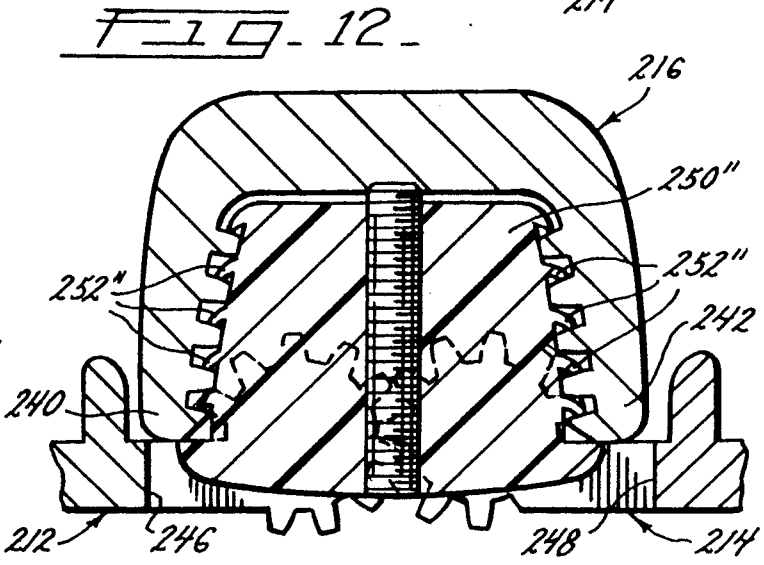
Figure 11:
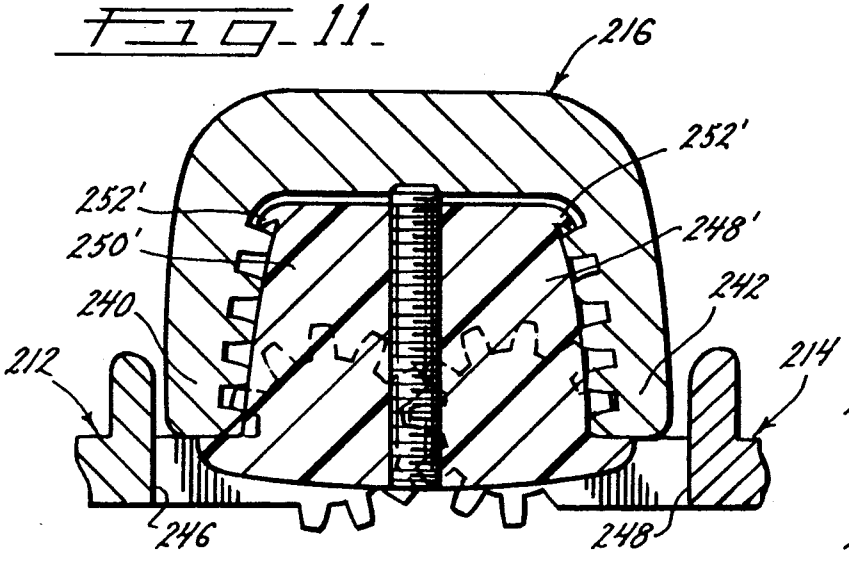

Alternative forms of thrust bearing members are illustrated in FIGS. 11 and 12 to facilitate replacement of the thrust bearing member without requiring disassembly of the hinge structure. A thrust bearing member 250' having resilient longitudinally extending projections or teeth 252' integrally formed at a rear end thereof is illustrated in FIG. 11. Each projection 252' extends laterally from the rear sides of the bearing member 250' and is configured for hinging or flexing movement toward the thrust bearing member 250'.

In the preferred form, each projection 252' is arranged for hinging movement about its respective edge portion integral with the thrust bearing member 250'. Projections 252' are configured to allow the thrust bearing member 250' to be inserted through the lateral recesses 246, 248 on the hinge member 212, 214 and be retained within the clamp member 216 by cooperating with the gear tooth profile thereon after the hinge structure is assembled.

Referring now to FIG. 12 therein is illustrated another modified form of a thrust bearing member 250''. Thrust bearing member 250'' has a series of resilient projections or teeth 252'' longitudinally extending along and from opposite lateral sides thereof. Preferably, the teeth 252'' are formed as an integral part of member 250'' and are configured for hinging or flexing movement toward the thrust bearing member 250''.

Attendant to insertion of the thrust bearing member 250'' through the lateral recesses 246, 248 on the hinge members 212, 214, the outer edge portion of each projection 252'' engages the gear tooth profile on the leg sections 240, 242 of the clamp member whereby the projections 252'' tend to hinge or flex about the respective edge portions integral with the thrust bearing member 250''. The resiliency of the projections 252'' also causes them to flex outwardly into the recesses or voids between the teeth on the profiled leg sections 240, 242 of the clamp member 216 whereby retaining the thrust bearing member 250'' in the lateral recesses 246, 248 of the hinge member 212, 214, respectively.

Figure 13:
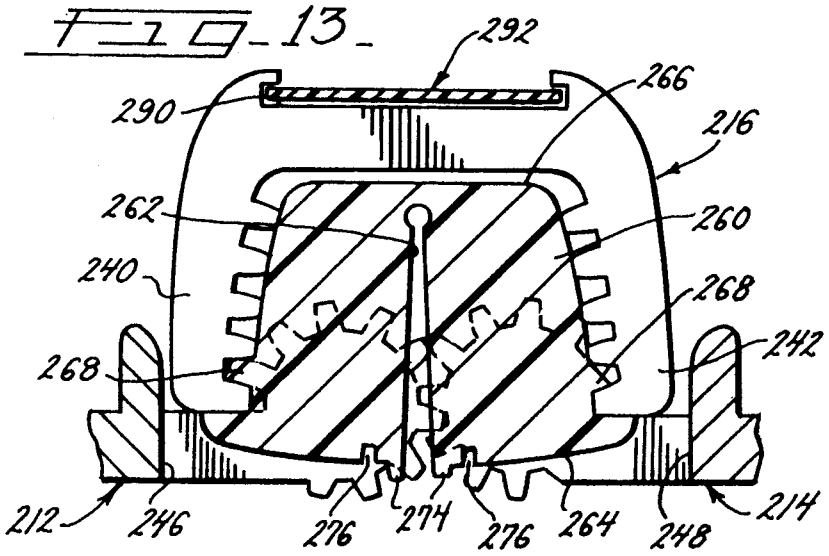
FIG. 13 illustrates a partial cross-sectional view of an alternative form of a thrust bearing assembly and furthermore illustrate one form of an aesthetic covering for the hinge structure.

Another modified form of thrust bearing assembly is illustrated in FIG. 13. The thrust bearing assembly illustrated in FIG. 13 includes a thrust bearing member 260 which extends across adjacent longitudinal edges of hinge members 212, 214 to inhibit relative movement therebetween. The longitudinal dimensions of the thrust bearing member 260 and the recesses 246, 248 are such that there is just sufficient clearance therebetween to permit the hinge members 212, 214 to rotate without binding or the bearing member 260.

The thrust bearing member 260 is preferably formed from a resilient plastic material, preferably of the type described above, and generally has a cross section that conforms to the cross-sectional configuration of the interior of clamp member 216. As illustrated in FIG. 13, the thrust bearing member 260 defines a centrally located, longitudinally extending V-shaped slot 262 extending from a front surface 264 and terminating inwardly of a rear surface 266 thereof; with the wider portion of the slot 262 opening to surface 264. Slot 262 extends the full length of the bearing member 260.

Figure 14:
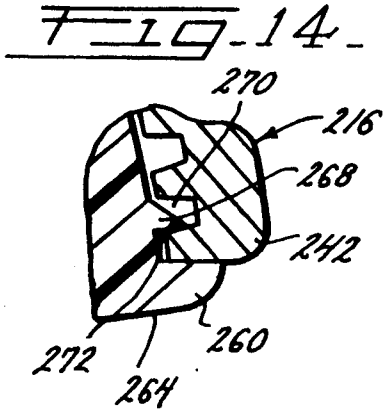
FIG. 14 is a fragmentary enlarged view of a modified portion of a hinge structure.

The thrust bearing member 260 further includes projections or teeth 268 longitudinally extending along and from opposite lateral sides of the thrust bearing member 260. As illustrated in FIG. 14, each projection 268 is preferably formed as an integral part of the thrust bearing member 260 and is configured to fit between the recesses or voids separating the gear teeth on the profiled leg sections of the clamp member 216. In a preferred form, each projection 268 includes a camming surface 270° and an abutting surface 272. The combined lateral width of opposed corresponding projections 268 is less than the lateral width of slot 262 in the general area of projections 268.

The front face 264 of the thrust bearing member 260 is provided with suitable means for facilitating lateral compression of the thrust bearing member as with a tool or the like. Two examples are schematically illustrated in FIG. 13, but it will be appreciated that means other than that shown would equally suffice.

As illustrated in FIG. 13, on opposite lateral sides of the V-shaped slot 262, the front face 264 of thrust bearing member 260 is provided with longitudinally extending flanges 274. Alternatively, small blind recesses 276 may be provided in the front face 264 of thrust bearing member 260 on opposite sides of slot 262. As will be understood, the flanges 274 and/or recesses 276 allow a tool to be used to facilitate insertion and withdrawal of the thrust bearing member 260 relative to the lateral recesses 246, 248 of the hinge members 212, 214, respectively. By pressing together the flanges 274, the lateral width of thrust bearing member 260 is sufficiently diminished by lateral compression of slot 262 to allow insertion/withdrawal of the bearing member 260 relative to the lateral recesses 246, 248 in the hinge members 212, 214, respectively. As will be appreciated, lateral compression of slot 262 allows the projections 268 to move past the gear tooth profile on the leg sections 240, 242 of the clamp members 216. Upon release, the resiliency of the thrust bearing member 260 forcibly urges the projections 268 into the recesses between the gear teeth on the profiled surface of the leg sections 240,242, whereby retaining the thrust bearing member 260 in the lateral recesses 246, 248 of the hinge member 212, 214, respectively.

Figure 15:
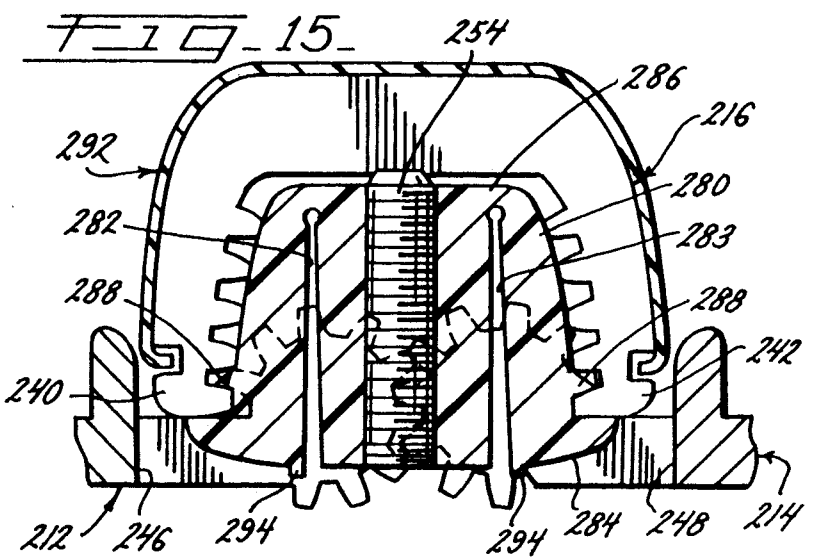
FIG. 15 illustrates a partial cross-sectional view similar to FIG. 13 showing another alternative form of a thrust bearing assembly and furthermore illustrating an alternative form of decorative treatment for the hinge structure.

FIG. 15 illustrates another form of a thrust bearing member 280 which is designed to accommodate a fastener, such as 254, passing through a central portion thereof. Thrust bearing member 280 is substantially similar to the thrust bearing member 260 illustrated in FIG. 13, except that thrust bearing member 280 defines two longitudinally extending V-shaped slots 282 and 283 extending from a front surface 284 and terminating inwardly of a rear surface 286 thereof; with the wide portion of each slot opening to surface 284. Both slots 282 and 283 extend the full length of the bearing member 280.

The thrust bearing member 280 further includes projections or teeth 288 longitudinally extending along and from opposite lateral sides of the thrust bearing member 276. The projections or teeth 288 on thrust bearing member 280 are substantially similar to the projection 268 on thrust bearing member 260 and, thus, no further detail need be provided therefore. Notably, the combined lateral width of both projections 288 is less than the combined lateral widths of slots 282 and 283 in the area of the projections 288.

Bearing member 280 is likewise provided with suitable means for effecting lateral compression of the bearing member 280. As illustrated, the front face 284 of bearing member 280 is provided with longitudinally extending flanges 294 disposed on outer lateral sides of slots 282 and 283. As will be understood, the flanges 294 are used in combination with a tool or the like to facilitate insertion and withdrawal of the thrust bearing member 280 relative to the lateral recesses 246, 248 of hinge member 212, 214, respectively. By pressing together the flanges 294, the lateral width of thrust bearing member 280 is sufficiently diminished by compression of slots 282, 283 to allow insertion/withdrawal of the bearing member 280 relative to the lateral recesses 246, 248 in the hinge members 212, 214, respectively. As will be appreciated, compression of the slots 282, 283 allows the projections 288 past the gear tooth profile on the leg sections 2409, 242 of the clamp member. Upon release, the resiliency of the thrust bearing member 280 forcibly urges the projections 288 into the recesses between the gear teeth on the profiled surface of the leg sections 240, 242 of clamp member 216, whereby retaining the thrust bearing member 280 within the lateral recesses 246, 248 of the hinge member 212, 214, respectively.

The exterior surface of clamping member 216 can be provided with decorative treatment means for enhancing the aesthetics of the hinge structure. As illustrated in FIG. 13, the clamping member 216 may be provided with a longitudinally extending channel or groove 290 defined on an exterior surface thereof. A decorative treatment 292 in the form of an interchangeable foil, sheet material, wood veneer, colored plastic, etc., is insertable within the channel 290 to enhance the aesthetic appearance of the hinge structure. Alternatively, and as illustrated in FIG. 15, a decorative treatment 294 in any suitable form may surround and be suitably secured to the exterior of the clamp member 216 to enhance the aesthetic features of the hinge structure.

Figure 16:
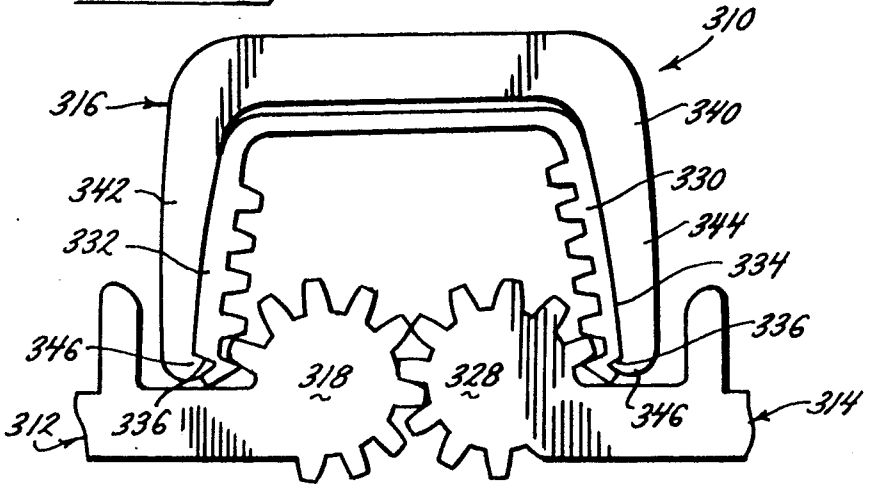
FIG. 16 schematically illustrates another form of hinge structure using a two-piece clamp member.

An alternative form of hinge structure 310 is illustrated in FIG. 16. The hinge structure 310 includes longitudinally extending hinge members 312 and 314 which are rotatably joined to each other and a longitudinally extending clamp member 316. The hinge members 312 and 314 are of substantially similar construction to hinge members 212 and 214 illustrated in FIGS. 7 and 8 and, thus, a detailed description need not be provided therefore. Suffice it to say, hinge members 312, 314 includes gear segments 318, 328, respectively, arranged along adjacent longitudinal edges thereof and preferably formed as integral parts thereof.

As illustrated in FIG. 16, clamp member 316 is a two-piece structure comprised of a flexible inner member 330 and a rigid outer member 340. As illustrated, both the inner member 330 and outer member 340 have a generally C-shaped cross-sectional configuration. The inner member 330 is fabricated as by extrusion and includes two spaced apart and joined leg sections 332, 334 which captively maintain gear segments 318, 328 therebetween. An interior surface of each leg section 332, 334 has a gear tooth profile which intermeshes and complements that of the gear segments 318, 328. Preferably, the inner member 334 is fabricated from a resilient material that returns the leg sections 332, 334 to a predetermined relationship with each other after allowing them to flex during assembly of the hinge structure 310. Each leg section 332, 334 of the inner member 330 is preferably formed, at a lower end, with a longitudinally extending channel or groove which opens to an exterior surface of the member 330.

The outer member 340 is likewise formed with a pair of leg sections 342, 344. As illustrated, the leg sections 342, 344 captively embrace the leg sections 332, 334 of the inner member 330. Preferably, the outer member 340 is formed from a rigid material and has a thickness which provides relatively high lateral stress resistance to the completed hinge structure. As will be appreciated, the thickness of the outer member may be adjusted to modulate the lateral stress resistance offered to the hinge structure by the clamp member 316. As illustrated, each leg section 342, 344 of the outer member 340 is provided at a lower end thereof with an inwardly directed, suitably shaped projection 346. Each projection 346 is received within the groove 336 provided on the inner member. Thus, when the clamp member is assembled, the inner and outer members 330, 340 are interconnected with each other.

Figure 17:
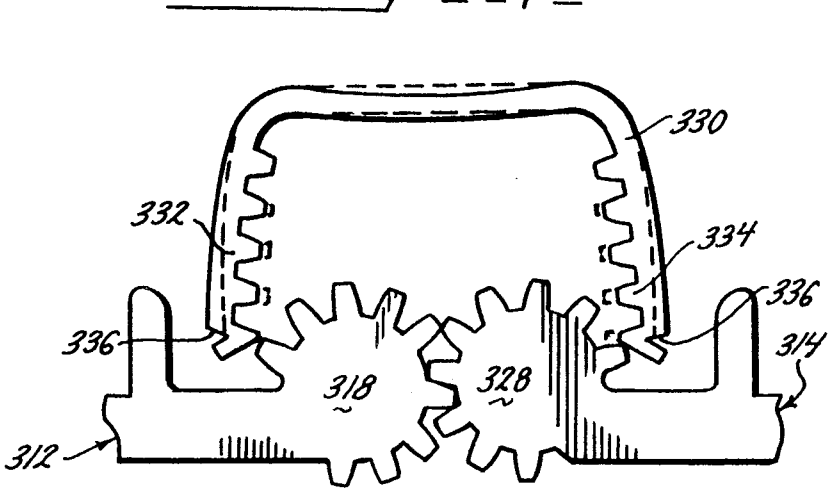
FIGS. 17 through 20 schematically illustrate progressive stages of assembly of the hinge structure illustrated in FIG. 16.

Assemblage of the hinge structure 310 is schematically illustrated in FIGS. 17 through 20. As illustrated in FIG. 17, the inner member 330 is interconnected with the gear segments as by laterally pressing the inner member against the gear segments 318, 328. As the inner member is pressed against the gear segments, the leg sections 332, 334 deflect outwardly into the solid line position to accommodate the wider dimension across the gear segments 318, 328 of the hinge members 312, 314.

Figure 18:
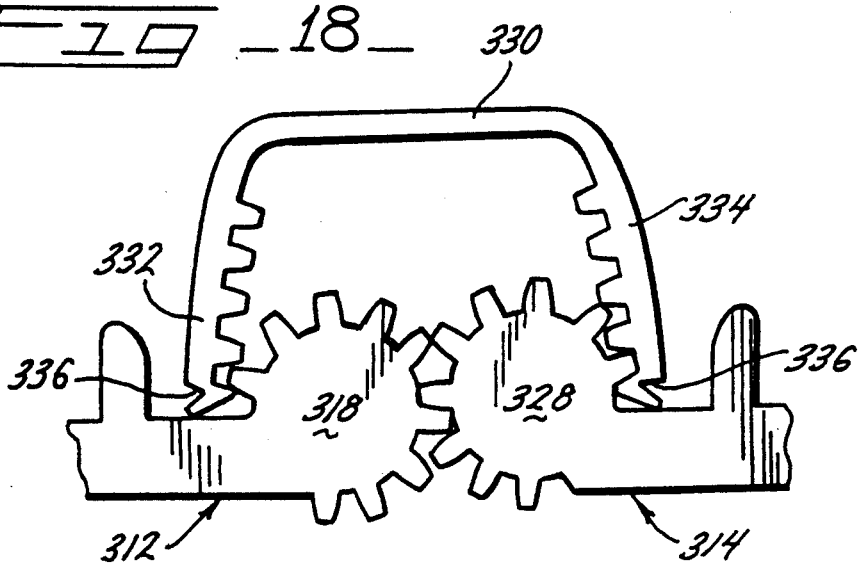

FIG. 18 illustrates a hinge subassembly which is formed when the interior profiled surface of the inner member 330 is in intermeshing engagement with the gear segments 318, 328 of the hinge member 312, 314, respectively. As illustrated, in a subassembled condition, the leg sections 332, 334 of the inner member 330 have returned from their deflected position, illustrated in FIG. 17, to their original "as extruded" dimensions.

Figure 19:
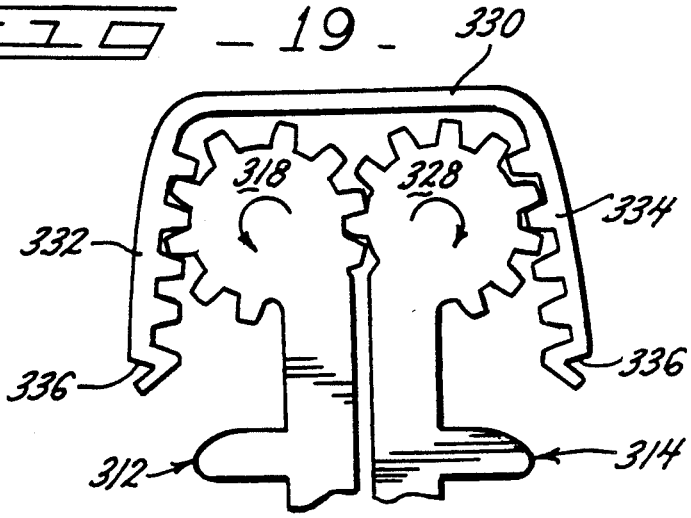

Next, the hinge members 312, 314 and their gear segments 318, 328, respectively, are rotated toward each other into a closed position illustrated in FIG. 19. As the hinge members 312, 314 are rotated toward each other into a closed position, the gear segments 318, 328 roll along the interior surface of the inner member such that the free ends of the leg sections 332, 334 are spaced from the gear segments 318, 328 to more easily be deflected inwardly by the downward pressure applied thereto during assembly of the outer member 340 thereto.

Figure 20:
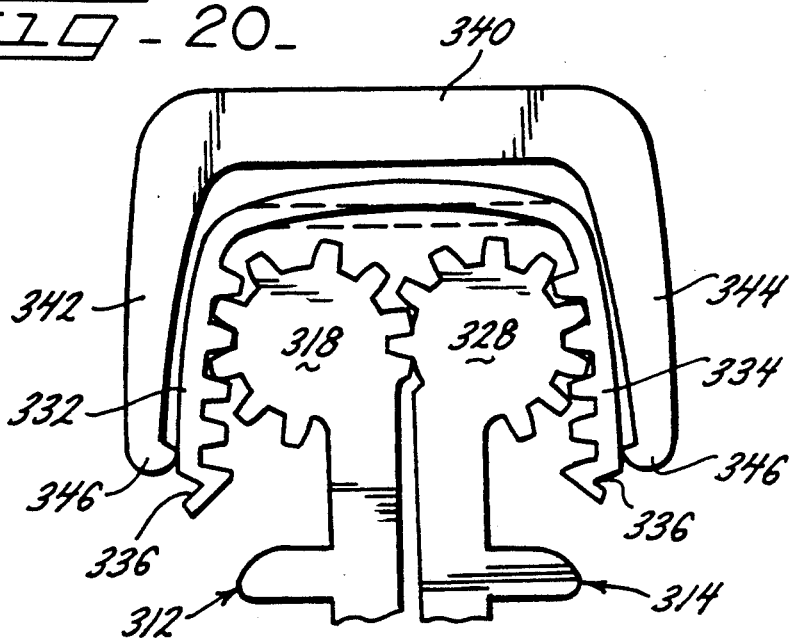

The next step in the procedure of assembling the hinge structure 310 involves connecting the rigid outer member to the inner member 330. As illustrated in FIG. 20, the rigid outer member 340 of the clamp member 316 is assembled to the inner member 330 as by pressing the outer member 340 over the inner member 330. As the outer member 340 is pressed over the inner member 330, the free ends of the leg sections 332, 334 of the inner member are easily deflected inwardly. The free ends are permitted to deflect inward because of the position of the gear segments 318, 328 which form a fulcrum over which the leg sections 332, 334 rotate. Sufficient lateral movement of the outer member 340 results in the projection 346 interlocking within the grooves 336 thereby completing the clamp member.

Figure 21:
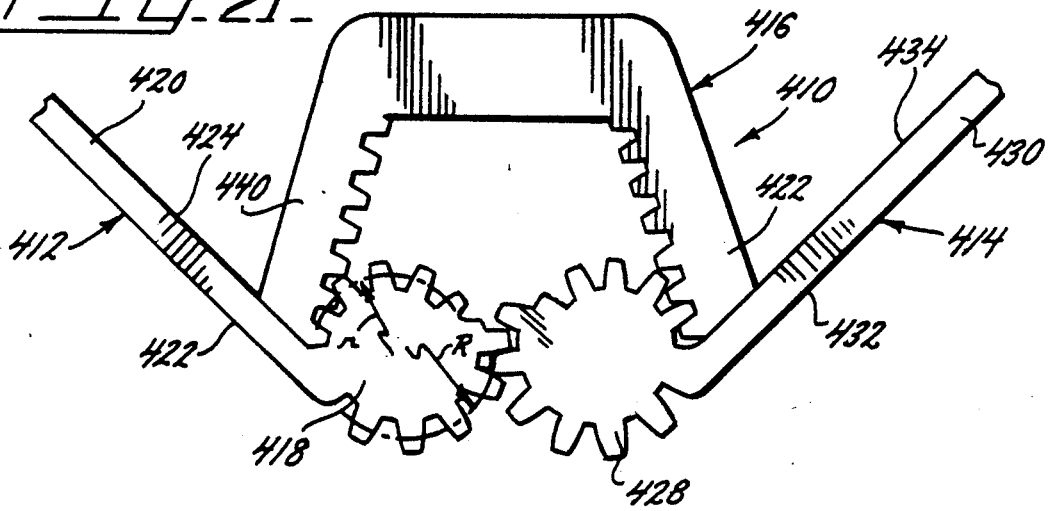
FIG. 21 is a fifth embodiment of a hinge structure according to the present invention with hinge members arranged in an open position and defining an encurded angle of about 270° therebetween.

An alternative form of hinge structure 410 is illustrated in FIG. 21. The hinge structure 410 includes longitudinally extending hinge members 412 and 414 which are rotatably joined along adjacent longitudinal edges. A longitudinally extending clamp member 416 maintains the hinge members in rotatable engagement. As illustrated, hinge member 412 includes a gear segment 418 with a leg section 420 extending therefrom. Leg section 420 defines inner and outer surfaces 422 and 424, respectively. Hinge member 414 also includes a gear segment 428 which is mutually intermeshed with gear segment 418 and also includes a leg segment 430. Leg segment 430 defines inner and outer surfaces 432 and 434, respectively.

As illustrated in FIG. 21, the longitudinally extending clamp member 416 has a channel or generally C-shaped cross section including two spaced-apart and joined leg sections 440 and 442 which captively maintain the gear segments 418, 428 of hinge members 412, 414, respectively, therebetween. An interior surface of each leg section 440 and 442 has a gear tooth profile which intermeshes with and complements that of the gear segments 418, 428. As illustrated, the leg sections 440 and 442 of the clamp member converge toward each other and permit hinge members 412, 414 to define an included angle of about 270° therebetween when the hinge members are moved to an open position illustrated in FIG. 21.

Each gear segment 418, 428 includes a series of gear teeth disposed at changing radii on the longitudinal edge of the hinge members. Adjacent gear teeth on a first portion of each of the gear segments are formed on the surface of a segment of a predetermined radius "R". Adjacent gear teeth on a second portion of the gear segments are formed on the surface of a segment of a radius "r" which is different from the predetermined radius "R". As illustrated in FIG. 21, in addition to being different, the radii for each segment have different focal points. When the hinge members 412, 414 are moved from one position to another, the axes of rotation of the hinge members shift as a function of the position of the hinge members.

Figure 22:
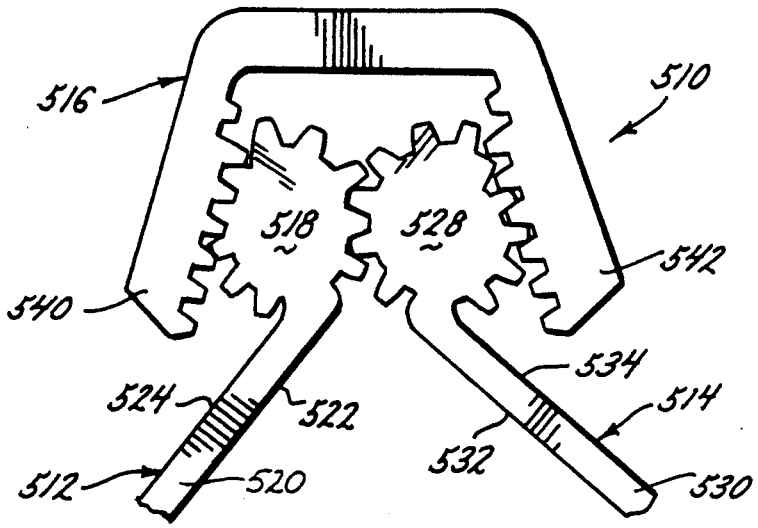
FIG. 22 is a sixth embodiment of a hinge structure according to the present invention.

Another modified form of hinge structure 510 is illustrated in FIG. 22. The hinge structure 510 includes longitudinally extending hinge members 512 and 514 which are rotatably joined along adjacent longitudinal edges. A longitudinally extending clamp member 516 maintains the hinge members in rotatable association as they move between open and closed positions.

As illustrated, hinge member 512 includes a gear segment 518 with a leg section 520 extending therefrom. Leg section 520 defines inner and outer surfaces 522 and 524, respectively. Hinge member 514 also includes a gear segment 528 which is in mutually intermeshing relation with gear segment 518 and also includes a leg section 530 extending therefrom. Leg section 530 defines inner and outer surfaces 532 and 534, respectively.

As illustrated in FIG. 21, the longitudinally extending clamp member 516 has a channel or generally C-shaped cross section including two spaced-apart and joined leg sections 540 and 542 which captively maintain gear segments 518, 528 of hinge members 512, 514 therebetween. As illustrated, leg sections 540 and 542 converge toward each other. An interior surface of each leg segment 536, 538 has a gear tooth profile which intermeshes with and complements that of the gear segments 518, 528.

Both clamping members 416 and 516 are advantageously symmetrical so that either end can be used to make the assembly, i.e., reversible. This requires that mutually intermeshing teeth on the gear segment be indexed for left or right, but the outer gear teeth which mesh with the interior profile of the clamp member are substantially the same on each hinge member.

Each gear segment 518, 528 includes a series of gear teeth formed on a surface having an epicyclic profile in cross section. As illustrated in FIG. 22, the gear teeth of both of the gear segments 518, 528 are formed on the surface of a spiral segment, the radius of which increases as the spiral segment extends from an inner surface toward an outer surface of each leg section. When the hinge members 512, 514 are moved from one position to another position, the axes of rotation of the hinge members shift as a function of the position of the hinge members.

Figure 23:
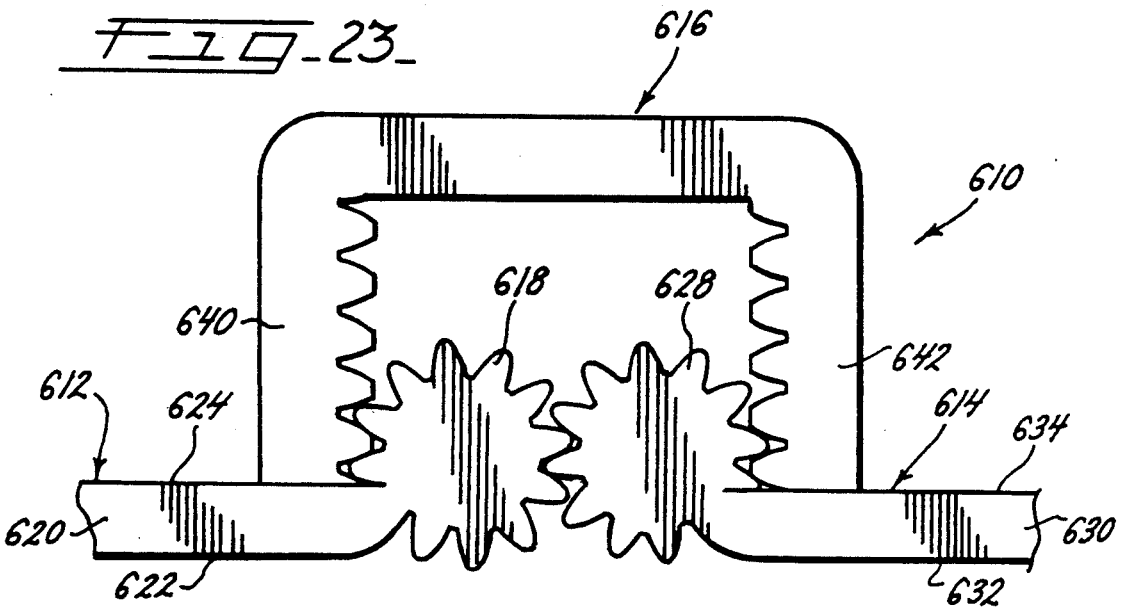
FIG. 23 is still another embodiment of a hinge structure according to the present invention.

Another form of hinge structure 610 is illustrated in FIG. 23. The hinge structure 610 includes longitudinally extending hinge members 612 and 614 which are rotatably joined along adjacent longitudinal edges thereof. A longitudinally extending clamp member 616 maintains the hinge members 612, 614 in rotatable association as they move between open and closed positions. As illustrated, hinge member 612 includes a gear segment 618 with a leg section 620 extending therefrom and defining inner and outer surfaces 622, 624. Hinge member 614 also includes a gear segment 628 which is in mutually intermeshing relation with gear segment 618 and also has a leg section 630 extending therefrom. Leg section 630 defines inner and outer surfaces 632 and 634, respectively.

As illustrated in FIG. 23, the longitudinally extending clamp member 616 has a channel-shaped cross section including two spaced-apart leg sections or racks 640 and 642 which extend generally parallel to each other and which captively maintain the gear segments 618, 628 of hinge members 612, 614, respectively, therebetween. An interior surface of each leg segment 640, 642 has a gear tooth profile which intermeshes with and complements that of the gear segments 618, 628. The distance between the leg sections 640 and 642 inhibits the segments 618 and 628 from becoming disassociated with the clamp member.

The three members of each hinge structure are assembled together by placing the geared segments of the hinge members in intermeshing relation so that the gear teeth intermesh and such that the leg sections of the hinge members are equally disposed relative to a predetermined plane. The hinge members are longitudinally moved relative to each other until the lateral recesses defined thereby are coextensively and laterally aligned. After properly aligning the hinge members relative to each other, the clamp member is assembled to the hinge member as by longitudinal sliding movement. When the clamp member is in its proper position, the gear segments of the hinge members are captively received between the leg sections of the clamp member.

As the clamp member is slidably moved along the length of the hinge members, the thrust bearing assembly is inserted between the hinge members and the clamp member. The lateral projections extending from opposite sides of the thrust bearing slidably engage the clamp member during endwise assembly and maintain the thrust bearing member within the lateral recesses defined on the hinge members.

A variation on assembly of the thrust bearing assembly to the hinge structure is to slide the clamp member over the meshed gear segments of the hinge members and subsequently insert the thrust bearing member as a secondary operation. The provision of flexible projections laterally extending from opposite sides of the bearing member would readily allow insertion of the thrust bearing member through the lateral recesses in the hinge members. Alternatively, the provision of longitudinal slots in the thrust bearing member would allow lateral compression thereof to effect insertion through the lateral recesses defined on the hinge members. Following insertion, the thrust bearing member would resiliently return to its original shape or configuration whereby allowing the lateral projections on the thrust bearing member to interengage with the profiled interior surface of the clamp member and inhibit removal of the thrust bearing member from the lateral recesses. As will be appreciated, replacement of worn bearing members could readily be effected by laterally compressing the longitudinal seat to allow removal of the thrust bearing member without requiring complete disassembly of the hinge structure.

The two-piece embodiment of the clamp member provides another variation on assembly of the hinge structure. The two-piece clamp member facilitates the parts of the hinge structure to be laterally assembled relative to each other without compromising lateral strength of the hinge structure. The ability of the flexible inner member of the two-piece clamp member to flex during assembly lessens the likelihood of damage to the interior profiled surface thereof. The provision of a two-piece clamp member also facilitates preassembly of the hinge structure allowing for development of a hinge structure inventory. Moreover, the inner member of the clamp member can be standardized, prelubricated and uniformly finished and thereby, less subject to dimensional variations caused by a variety of anodizing densities and thicknesses which can vary with color and other specifications. The assembly of the inner member to the hinge member promotes fabrication of a hinge subassembly which can be used with a variety of differently shaped outer members. Notably, the outer member of the clamp member is formed from a material preferably having extremely high lateral stress resistance thereby affording rigidity to the hinge structure. Because the inner member may be standardized, the outer member can have a variety of finishes without concern regarding its mechanical performance as a geared surface or the precision of the totality of the interior surface thereof. Furthermore, the space savings benefits inherent with lateral assembly of the parts of the hinge structure as compared to endwise assembly of the hinge structure are apparent.

In all of the embodiments illustrated, the hinge members are movable between an open or first position and a closed or second position. As the hinge members move between positions, the gear segments roll along the interior surface of the leg sections of the clamp member such that each hinge member moves about an axis of rotation which shifts as a function of the position of the hinge member.

The ability of the gear segments to roll along the interior surface of the clamp member rather than pivot about a fixed rotational axis furthermore allows the hinge members to be designed with a large gear segment surface area. The large surface area of each gear segment facilitates an increase in the bearing surface which contacts the upper and lower surfaces of the thrust bearing assembly. Moreover, the shifting rotational axes of the hinge members permits the gear segments to move across the upper and lower bearing surfaces on the thrust bearing member to provide a "sliding" action whereby facilitating an increase in wear characteristics for the thrust bearing member by distributing wear over a larger bearing surface area presented to the gear segments.

In the embodiments illustrated in FIGS. 21 and 22, each gear segment has an epicyclic profile. As illustrated in FIG. 21, the epicyclic profile can be provided by arranging a series of gear teeth on a first segment having a predetermined radius "R" and arranging another series of gear teeth on a second segment having a radius "r" which is different from the predetermined radius. As illustrated in FIG. 22, the epicyclic profile for the gear segments can also be provided by providing a spiral cross section including blended radii on different segments of each gear segment. The epicyclic profile on the gear segments is complemented with a profile on the clamp member which facilitates the aesthetic design thereof.

The ability of the gear segments to roll along an interior surface of the clamp member furthermore reduces galling effects normally associated with hinge members and facilitates the manufacturing process. Because the gear segments roll along the interior surface of the clamp member, the hinge members move about an axis of rotation which shifts as a function of the position of the hinge members. Accordingly, the clamp member is disposed proximate to hinge members to enhance security.

From the foregoing, it will be observed that numerous modifications and variations can be effected without departing from the true spirit and scope of the novel concept of the present invention. It will be appreciated that the present disclosure is intended to set forth exemplifications of the invention which are not intended to limit the invention to the specific embodiments illustrated. The disclosure is intended to cover by the appended claims all such modifications as fall within the scope of the claims.

What is claimed is:

1. A pinless hinge structure comprising: a pair of longitudinally extending hinge member which are rotatably joined to each other for movement between open and closed positions, each of said hinge members having a longitudinally extending gear segment provided thereon; a longitudinally extending clamp member configured to intermesh with each of said gear segments such that each hinge member moves about an axis of rotation which shifts with respect to the clamp member as a function of the position of said hinge members; and a longitudinally extending rod-like element provided between said hinge members to define a common pivotal axis for said hinge members, said common pivotal axis shifting with respect to the clamp member as a function of the position of said hinge members.

2. The pinless hinge structure according to claim 1, wherein said clamp member has two leg sections with said gear segments of the hinge members captively maintained therebetween, each leg section having a gear tooth profile which complements that provided on said gear segments.

3. The pinless hinge structure according to claim 1 further including thrust bearing means for inhibiting longitudinal movement of the hinge members relative to each other, said thrust bearing means including a thrust bearing member extending across adjacent longitudinal edges of said hinge members.

4. The pinless hinge structure according to claim 3, wherein said thrust bearing member includes longitudinal projections laterally extending from opposite sides of said bearing member, said projections being configured to engage with a gear tooth profile on said clamp member attendant to insertion of said thrust bearing members within coextensive lateral recesses defined on said hinge members.

5. The pinless hinge structure according to claim 1 wherein said clamp member is comprised of at least two interconnected members.

6. A pinless hinge structure comprising: a pair of longitudinally extending hinge members which are rotatably joined to each other for movement between open and closed positions, said hinge members having mutually intermeshing gear segments extending along adjacent longitudinal edges thereof; each of the gear segments having a surface of irregular radius with gear teeth formed thereon; and a longitudinally extending clamp member configured to intermesh with each of said gear segments such that each of said hinge members moves about an axis of rotation which shifts as a function of the position of said hinge members.

7. The pinless hinge structure according to claim 6 wherein said clamp member has two spaced-apart and joined leg sections with said gear segments of said hinge members captively maintained therebetween, each of said leg sections having a gear tooth profile which complements that of said gear segment.

8. The pinless hinge structure according to claim 6 wherein each gear segment is formed on the surface of a spiral segment, with one gear segment having an increasing radius and a second gear segment having a decreasing radius, and wherein the sum of said radii is substantially constant throughout rotation of the hinge members.

9. The pinless hinge structure according to claim 6 further including thrust bearing means for inhibiting longitudinal movement of said hinge members relative to each other, said thrust bearing means including a thrust bearing member extending across adjacent longitudinal edges of said hinge members.

10. The pinless hinge structure according to claim 6 further including thrust bearing means for inhibiting longitudinal movement of the hinge members relative to each other, said thrust bearing means including a thrust bearing member removably secured within coextensive lateral recesses defined by said hinge members and extending across adjacent longitudinal edges of said hinge members, said thrust bearing member having longitudinally extending projections along lateral sides thereof for engaging with the gear tooth profile on said clamp member.

11. The pinless hinge structure according to claim 6 wherein said leg sections of said clamp member are at least partially formed from a resilient material which facilitates assemblage of the hinge structure and maintains pressure on the gear segments of the hinge members captively maintained therebetween.

12. The pinless hinge structure according to claim 6 wherein said clamp member is a two-piece structure including a flexible longitudinally extending inner member embraced by and connected to a longitudinally extended outer member.

13. A pinless hinge structure comprising: a pair of longitudinally extending hinge members which are rotatably joined to each other for movement between open and closed positions, said hinge members having mutually intermeshing gear segments extending along adjacent longitudinal edges thereof; a longitudinally extending clamp member configured to intermesh with each of said gear segments such that each of said hinge members moves about an axis of rotation which shifts as a function of the position of said hinge members, said clamp member having two spaced-apart and joined leg sections with said gear segments of said hinge members captively maintained therebetween, said leg sections having gear tooth profiles which complement those of said gear segments; thrust bearing means for inhibiting longitudinal movement of the hinge members relative to each other, said thrust bearing means including a thrust bearing member removably secured within coextensive lateral recesses defined by said hinge members and extending across adjacent longitudinal edges of said hinge members, said thrust bearing member having longitudinally extending projections along lateral sides thereof for engaging with the gear tooth profile on said clamp member, said thrust bearing means further defining at least one longitudinally extending slot permitting lateral compression of the thrust bearing member to facilitate insertion and removal thereof from the lateral recesses defined by the hinge members 14. A pinless hinge structure comprising: a pair of longitudinally extending hinge members which are rotatably joined to each other by mutually intermeshing gear segments formed on adjacent longitudinally extending edges of said hinge members, and being provided with a series of gear teeth formed on the surface of a spiral, said gear segments being held in rotatably joined association as said hinge members move between open and closed positions by a clamp member, said clamp member having a gear tooth profile which complements and coacts with the profiles of said gear segments such that each of said hinge members moves about an axis of rotation which shifts as a function of the position of said hinge members.

15. The pinless hinge structure according to claim 14 wherein said clamp member comprises two leg sections defining a rack profile which embraces said gear segments of said hinge members therebetween.

16. A pinless hinge structure comprising: a pair of longitudinally extending hinge members which are rotatably joined to each other by mutually intermeshing ear segments formed on adjacent longitudinally extending edges of said hinge members, each of said gear segments being provided with a series of gear teeth, with adjacent gear teeth on a first portion of each gear segments being formed on the surface of the segment having a predetermined radius and with adjacent gear teeth on a second portion of said gear segment being formed on the surface of the segment having a radius which is different form said predetermined radius, said gear segments being held in rotatably joined association as said hinge members move between open and closed positions by a clamp member, said clamp member having a gear tooth profile which complements and coacts with the profiles of said gear segments such that each of said hinge members moves about an axis of rotation which shifts as a function of the position of said hinge member.

17. A pinless hinge structure comprising: a pair of longitudinally extending hinge members which are rotatably joined to each other by mutually intermeshing gear segments formed on adjacent longitudinally extending edges of said hinge members, said gear segments being held in rotatably joined association as said hinge members move between open and closed positions by a clamp member, said clamp member having a gear tooth profile which complements and coacts with the profiles of said gear segments such that each of said hinge members moves about an axis of rotation which shifts as a function of the position of said hinge member, said clamp member comprising two leg sections defining rack profiles which embrace said gear segments of said hinge members therebetween, said leg sections of said clamp member converging toward each other and permitting said hinge members to define an included angle of at least about 270° therebetween when said hinge members are arranged in an open position.

18. The pinless hinge structure according to claim 17 further including a thrust bearing assembly arranged within coextensive lateral recesses defined by said hinge members to inhibit longitudinal movements of said hinge members relative to each other.

19. The pinless hinge structure according to claim 17 wherein said thrust bearing assembly comprises a thrust bearing member having one or more longitudinal projections laterally extending from opposite sides of said thrust bearing member, said projections interengaging with the gear tooth profile on said clamp member attendant to insertion of said thrust bearing member within the lateral recesses defined by said hinge members.

20. A pinless hinge structure comprising a pair of longitudinally extending hinge members which are rotatably joined to each other by mutually intermeshing gear segments formed on adjacent longitudinally extending edges of said hinge members, said gear segments being held in rotatably joined association as said hinge members move between open and closed positions by a clamp member, said clamp member having a gear tooth profile which complements and coacts with the profiles of said gear segments such that each of said hinge members moves about an axis of rotation which shifts as a function of the position of said hinge member, and further including a thrust bearing assembly arranged within coextensive lateral recesses defined by said hinge members to inhibit longitudinal movements of said hinge members relative to each other, said thrust bearing assembly comprising a thrust bearing member having one or more longitudinal projections laterally extending from opposite sides of said thrust bearing member, said projections interengaging with the gear tooth profile on said clamp member attendant to insertion of said thrust bearing member within the lateral recesses defined by said hinge members, said thrust bearing member comprising at least two longitudinal slots permitting lateral compression of the thrust bearing member to facilitate insertion/removal thereof from the lateral recesses defined by the hinge members.

21. The pinless hinge structure according to claim 20 wherein said thrust bearing member further defines means for facilitating lateral compression of the bearing member as with a tool or the like.

22. A pinless hinge structure comprising a pair of longitudinally extending hinge members which are rotatably joined to each other by mutually intermeshing gear segments formed on adjacent longitudinally extending edges of said hinge members, said gear segments being held in rotatably joined association as said hinge members move between open and closed positions by a clamp member, said clamp member having a gear tooth profile which complements and coacts with the profiles of said gear segments such that each of said hinge members moves about an axis of rotation which shifts as a function of the position of said hinge member, each hinge member further including a leg segment extending outwardly from the gear segment and defining inner and outer surfaces, and wherein the gear teeth on said gear segments are formed on the surface of a spiral segment, the radius of which increases as the spiral segments extends from the inner surface toward the outer surface of the leg section.

23. A hinge comprising a first hinge member having a gear segment along one of the edges; a second hinge member having a gear segment along one of its edges and located parallel to the gear segment of the first hinge member, an inner clamp member fitted over the gear segments of the two hinge members and having gear teeth arranged in opposed racks, the racks meshing with the gear segments; the inner clamp member possessing enough flexibility to spread sufficiently to pass over the gear segments and causes its teeth to engage the teeth of the segments, and an outer clamp member fitted over the inner clamp member, the outer clamp member being more rigid than the inner clamp member and further being configured to prevent the inner clamp member from spreading and disengaging from the teeth of the gear segments for the hinge members.

24. A hinge according to claim 23 wherein the clamp members are generally C-shaped in cross-section, with each having a pair of legs; and wherein the racks are on the legs of the inner clamp member.

25. A hinge according to claim 24 and further comprising means for connecting the outer clamp member to the inner clamp member.

26. A hinge according to claim 24 wherein the means for connecting includes indentations in the legs of one of the clamp members and projections on the legs of the other clamp member, with the projections being received in the indentations.

27. A hinge according to claim 23 wherein the gear segments of the two hinge members further mesh with each other.

28. A hinge comprising: a first hinge member having a gear segment along one of its edges and a recess which opens laterally out of the hinge member through the gear segment; a second hinge member having a gear segment along one of its edges and a recess which opens laterally out of that hinge member through the gear segment, the recess of the second hinge member opening toward the recess in the first hinge member; a clamp member fitted over the gear segments of the two hinge members and having gear teeth arranged in opposed racks with the one rack meshing with the gear segment of the first hinge member and the outer rack meshing with the cedar segment of the second hinge member; and a bearing member located in the recesses of the two hinge members to prevent the hinge members from being displaced longitudinally with respect to each other, the bearing member being engaged with at least some of the teeth of the racks on the clamp member to retain it within the recesses of the hinge members, the bearing member being contractible such that it may be inserted or withdrawn between the teeth on the racks of the clamp member.

29. A hinge according to claim 28 and further including a set screw threaded through the bearing member and bearing against the clamp member to prevent the clamp member from being displaced longitudinally with respect to the bearing member and gear segments.

30. A hinge according to claim 28 wherein the bearing member has at least one slot which extends parallel to the gear segments and opens out of the face of the gear segment that is exposed at the recesses but not the opposite one that is presented toward the clamp member, to enable the bearing member to be contracted enough to be disengaged form the racks of the clamp member.

31. A hinge according to claim 28 wherein the gear segments of the two hinge members mesh.

* * * * *